United States Patent [19]

Bonnet et al.

[11] Patent Number: 4,466,451

[45] Date of Patent: Aug. 21, 1984

[54] METHOD FOR AROMATIZING TOBACCO SMOKE

[75] Inventors: Jacques Bonnet, Lausanne; Pierre Jaccard, Bussingy; Serge Veluz, Epalinges, all of Switzerland

[73] Assignee: Baumgartner Papiers S.A., Crissier, Switzerland

[21] Appl. No.: 384,944

[22] Filed: Jun. 4, 1982

[30] Foreign Application Priority Data

Jun. 10, 1981 [CH] Switzerland ..... 3787/81

[51] Int. Cl.[3] ..... A24D 3/04; A24D 3/14; A24D 3/16

[52] U.S. Cl. ..... 131/335; 131/342; 131/343; 131/344

[58] Field of Search ..... 131/335, 337, 342, 343, 131/344

[56] References Cited

U.S. PATENT DOCUMENTS

| | | | |
|---|---|---|---|
| 3,390,686 | 7/1968 | Irby et al. | 131/337 |
| 3,972,335 | 8/1976 | Tiggelbeck et al. | 131/342 |
| 4,311,156 | 1/1982 | Bonnet et al. | 131/335 |

*Primary Examiner*—V. Millin

*Attorney, Agent, or Firm*—Oblon, Fisher, Spivak, McClelland & Maier

[57] ABSTRACT

A highly-porous silica gel charged with 10% by weight of anethole and 20% by weight of deactivating agent is used in the tip of a cigarette in order to aromatize the smoke drawn from the cigarette in a simple way with anethole even after prolonged storage of the cigarette.

9 Claims, No Drawings

METHOD FOR AROMATIZING TOBACCO SMOKE

The invention relates to a method for aromatizing tobacco smoke drawn from a cigarette, and a cigarette endpiece, in particular a cigarette filter for carrying out this method.

It is already known that an aromatic compound is sprayed, for example, on crushed tobacco, the cigarette pack or the acetate filter during manufacture to produce aromatized cigarettes. These methods, however, frequently have the disadvantage that manufacture of aromatized cigarettes must be performed in isolation from the production of other cigarettes owing to the high volatility of the aromatic compound on one hand and the strong affinity of the tobacco for the latter, since otherwise the other cigarettes would likewise be tinged with the flavour. When the manufacture of aromatized cigarettes is only performed in relatively small quantities owing to limited demand, the entire production plant must be decontaminated before conversion to non-aromatized cigarettes, which is obviously extremely inconvenient and costly, since apart from cleaning costs the entire production plant must be shutdown throughout the cleaning operations.

Since increasing numbers of milder cigarettes have been in demand, i.e. cigarettes with low nicotine and tar content, it would also be of interest to aromatize the smoke produced by these cigarettes, for example by means of tobacco extract or synthetic tobacco aroma. the methods tried so far, however, all have the disadvantage that a relatively large amount of often highly expensive aromatic compound is required for a sufficient aromatizing and that the aromatic compound has evaporated in a short time, so that no further satisfactory effect is obtained and cigarettes of this kind can only be stored for an inadequate period.

The object of the present invention is to provide a method without the disadvantages outlined above, i.e. which enables for example the manufacture of aromatized filter cigarettes without contaminating the production plant, requires relatively small amounts of aroma substances, is simple to use and allows the cigarettes aromatized in this way to be stored for a prolonged period.

This object is realised by a method of the aforesaid type by the use of a porous silica gel charged with aroma substances in the cigarette mouthpiece.

It has been found that granular, porous silica gel has an excellent adsorption capacity for storing aroma substances and even when such aroma carriers charged with aroma substances are stored in open conditions for a time of several months, the evaporation of the stored aroma substance is so small at room temperature (approx. 18° to 22° C.), that there is still a sufficient amount thereof left in the aroma carrier. If, on the other hand, the aroma carrier charged with aroma substances in this way is in a warm and moist flow of smoke from a cigarette, then a determined amount of aroma substance is emitted as required to the warm, moist flow of smoke passing by, each time the smoker draws on a cigarette of this kind.

It is advantageous to use a synthetic tobacco aroma, a natural or synthetic tobacco extract, a natural or synthetic tobacco smoke extract or a phenolic ether, for example anethole or anisole, as aromatic compound.

It has been found suitable to use a silica gel with a specific surface area within the range from 300 to 700 $m^2/g$, preferably of around 550 $m^2/g$. It is also best to use a silica gel with a pore volume within the range of 0.6 to 0.85 ml/g, preferably around 0.73 ml/g.

Since the adsorption capacity of silica gel is too large when using certain aroma substances to achieve the desired emission of aroma to the smoke flowing past, it is suitable when using aroma substances of this kind to adjust the adsorption capacity of the silica gel to a required value with the aid of a deactivating agent. It can then be advantageous to use propylene glycol as deactivating agent.

In order to obtain a good aromatization of the cigarette smoke, it has also been found useful to use a silica gel charged with 16 to 44% by weight, preferably around 30% by weight, of aroma substances or aroma substances and deactivating agent, with respect to the uncharged silica gel.

It is further advantageous to use a silica gel with 5 to 18% by weight of water, preferably around 8%, at an equilibrium of 20° C. and 50% relative humidity, with respect to the silica gel dry substance. The weight of the dry silica gel is determined by exposing the silica gel charged with moisture to a temperature of 160° C. until its weight remains constant, which is its dry weight.

It is also suitable to place the silica gel charged with aroma substances in at least one part of the cigarette filter. In this case it is advantageous to incorporate the silica gel charged with aroma substances in at least one part of the filter material to be used for a cigarette filter, for example of a double-filter.

In order to obtain a good aromatization of the cigarette smoke, it has also been found useful to use a silica gel charged with 16 to 44% by weight, preferably around 30% by weight, of aroma substances or aroma substances and deactivating agent, with respect to the uncharged silica gel.

It is further advantageous to use a silica gel with 5 to 18% by weight of water, preferably around 8%, at an equilibrium of 20° C. and 50% relative humidity, with respect to the silica gel dry substance. The weight of the dry silica gel is determined by exposing the silica gel charged with moisture to a temperature of 160° C. until its weight remains constant, which is its dry weight.

It is also suitable to place the silica gel charged with aroma substances in at least one part of the cigarette filter. In this case it is adavantageous to incorporate the silica gel charged with aroma substances in at least one part of the filter material to be used for a cigarette filter, for example of a double-filter.

A further object if the present invention is a cigarette endpiece, in particular a cigarette filter, for carrying out the method a chamber containing at least the granular silica gel charged with aroma substances.

Object of the present invention is further a use of the method according to the invention for anetholization of tobacco smoke.

COMPARISON EXAMPLE

Filter cigarettes of the same make and with the same moisture content were smoked under standard conditions, i.e. one draw of 35 ml volume and 2 seconds duration every minute, while at the same time their flavour was checked by test persons, whereby the chamber filters used were filled on one had with activated carbon made from coconut and charged with anethole and on the other hand, according to the invention, with highly porous, granular silica gel charged with anethole.

The following results were obtained:

| Anethole content with respect to the weight of the uncharged carrier material. | Propylene glycol as deactivating agent related to the weight of the uncharged carrier material. | Aromatizing effect with activated carbon made from coconut as carrier material | Aromatizing effect with silica gel as carrier material |
|---|---|---|---|
| 10% by weight | — | none | weak |
| 20% by weight | — | none | fairly good |
| 30% by weight | — | too great | good to strong |
| 10% by weight | 20% by weight | none | good to strong |

As can be seen, when using silica gel as carrier and storage material for the anethole, a satisfactory aromatization of the smoke can be achieved with as little as 10% by weight of anethole charging (related to the weight of the uncharged silica gel), if the optimization rule is followed that the aroma substance and deactivating agent together form approx. 30% by weight with respect to the uncharged silica gel. Since, for example, the deactivating agent propylene glycol is considerably cheaper than anethole, this is also of interest for cost reasons. With the use of activated carbon as carrier and storage material for the anethole, it is impossible to achieve an aromatization of the smoke in any way with 10% by weight of anethole.

In order to test the storability, cigarettes provided with chamber filters containing highly porous, granular silica gel charged with 10% by weight anethole and 20% by weight propylene glycol (in each case with respect to the weight of the uncharged carrier material) were smoked under standard conditions and the anethole content present determined during nine draws in the smoke in the particulate phase, shortly after charging the silica gel used and again after around three months, whereby in both cases an anethole content (in the particulate phase) of 0.44 mg/cigarette was determined. For this test a silica gel was used manufactured under the trade name "Polygel W-45" by the company Chemische Fabrik Uetikon, Switzerland, with a specific area of 550 $m^2/g$ and a pore volume of 0.73 ml/g.

Instead of filling the silica gel charged with an aroma substance in the chamber of a chamber filter, it is also possible to provide it in a tip section enclosed in the axial direction by means of two sealing walls with negligible filter effect, so that for example the tar and nicotine content of the smoke passing through is practically unaltered and therefore corresponds to the smoke of a non-filter cigarette, while on the other hand additionally aromatizing the smoke flowing through.

It is also possible to arrange the silica gel charged with an aroma substance between the fibres of the filter material strand by means of a bonding agent during manufacture of a cigarette filter. For a double-filter, the carrier material charged with aromatic compounds would preferably be placed in the plug of the filter adjoining the tobacco section of the filter cigarette.

We claim:

1. A method for aromatizing tobacco smoke drawn from a cigarette which comprises charging a highly-porous silica gel in the cigarette mouthpiece with 10–20% by weight of aroma substances selected from the group consisting of a synthetic tobacco aroma, a natural or synthetic tobacco extract, a natural or synthetic tobacco smoke extract or a phenolic ether aroma substance, wherein the adsorption capacity of said silica gel is adjusted with the deactivating agent, propylene glycol.

2. The method as claimed in claim 1, wherein the silica gel has a specific surface area within the range of 300 to 700 $m^2/g$.

3. The method as claimed in claim 1, wherein the silica gel has a pore volume within the range of 0.6 to 0.85 ml/g.

4. The method as claimed in claim 1, wherein the silica gel is charged with aroma substances to 16 to 44% by weight, with respect to the uncharged silica gel.

5. The method as claimed in claim 1, wherein the silica gel contains 5 to 18% by weight, of water at an equilibrium of 20° C. and 50% relative humidity, with respect to the dry weight.

6. The method as claimed in claim 1, wherein the silica gel is charged with aroma substances in at least one part of a cigarette filter.

7. The method as claimed in claim 6, wherein the silica gel charged with aroma substances is incorporated in at least one part of the filter material used in a cigarette filter.

8. The method as claimed in claim 1, wherein the phenolic ether aroma substance is anethole or anisole.

9. A cigarette endpiece comprising a chamber containing at least granular silica gel charged with 10–20% by weight of aroma substances selected from the group consisting of a synthetic tobacco aroma, a natural or synthetic tobacco extract, a natural or synthetic tobacco smoke extract or a phenolic ether aroma substance, wherein the adsorption capacity of said silica gel is adjusted with the deactivating agent, propylene glycol.

* * * * *